US006446723B1

(12) United States Patent
Ramos et al.

(10) Patent No.: US 6,446,723 B1
(45) **Date of Patent: *Sep. 10, 2002**

(54) CABLE CONNECTION TO SENSORS IN A WELL

(75) Inventors: Rogerio Tadeu Ramos, Bethel, CT (US); Willem A. Wijnberg, Houston, TX (US); Christian Jean Marcel Chouzenoux, Saint Cloud; Stephanie Marie-Odile Montillet, Chatenay-Malabry, both of (FR)

(73) Assignee: Schlumberger Technology Corporation, Ridgefield, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/328,729

(22) Filed: Jun. 9, 1999

(51) Int. Cl.[7] ..... E21B 17/00; E21B 19/00

(52) U.S. Cl. ..... 166/285; 166/65.1; 166/242

(58) Field of Search ..... 166/65.1, 242.2, 166/285, 286, 287, 288, 289, 290, 291, 292, 293, 294, 295

(56) References Cited

U.S. PATENT DOCUMENTS

| | | | | |
|---|---|---|---|---|
| 2,283,117 A | | 5/1942 | Arutunoff | 103/87 |
| 3,857,443 A | * | 12/1974 | Cole | 166/295 |
| 4,569,392 A | * | 2/1986 | Peterman | 166/65.1 |
| 4,705,112 A | * | 11/1987 | Meadows | 166/285 |
| 4,775,009 A | * | 10/1988 | Wittrisch et al. | 166/285 |
| 5,148,864 A | * | 9/1992 | Willis et al. | 166/65.1 |
| 5,348,084 A | * | 9/1994 | Fay et al. | 166/65.1 |
| 5,732,771 A | * | 3/1998 | Moore | 166/65.1 |

FOREIGN PATENT DOCUMENTS

| | | | |
|---|---|---|---|
| EP | 0 208 178 | 1/1987 | H01B/7/04 |
| FR | 2 231 080 | 12/1974 | H01B/7/08 |

* cited by examiner

*Primary Examiner*—William Neuder
(74) *Attorney, Agent, or Firm*—William L. Wang; William B. Batzer; John J. Ryberg

(57) ABSTRACT

A description of a cable for connection to sensors permanently downhole is provided, the cable comprising a plurality of elongate conductors capable of operative connection to sensors, a sheath surrounding the elongate conductors and holding the conductors so as to extend substantially parallel to an elongate axis, wherein the sheath has a cross-section, perpendicular to the direction of the elongate axis, which has a major dimension and a minor dimension. The cross-section of the cable is thus flattened and can be in the shape of an ellipse, a crescent or comprise a circle with wing-like portions attached on opposite sides of the circle. The sheath is made from a resilient material, so as to provide a robust outer surface of the cable which ensures the cable can be placed downhole without breaking. A number of the elongate conductors are grouped together and inter-weaved in a helical arrangement, so as to reduce electrical cross-talk between the conductors. Strengthening cords are included in the sheath which are hollow to allow passage of fiber optic cables within the wire cords. A method of cementing a well is also provided, comprising forming a borehole, placing elongate tubing within the borehole to form an annulus in the borehole, and placing within the annulus a cable with a cross-section which has a major and a minor dimension, such that the minor dimension extends along a radius of the borehole, and passing cement, or thixotropic fluid, downhole to secure the cable in the annulus.

29 Claims, 5 Drawing Sheets

CABLE CONNECTION TO SENSORS IN A WELL

FIELD OF THE INVENTION

This invention relates to a cable for connection to sensors permanently downhole within a well, to a method of placing such a cable downhole, and to a well with such a cable permanently in position.

BACKGROUND OF THE INVENTION

Cables used within wells to provide power downhole are typically circular in cross-section, although it is known to use power cables with a non-circular cross-section downhole. These power cables are placed within production tubing to reach, for example, a motor or pump and are large gauge insulated copper conductors bound together with a pre-formed/interlocking steel tape. The power cable is not placed permanently downhole, generally being replaced when the motor or pump to which it supplies power is removed from the well for repair or maintenance.

SUMMARY OF THE INVENTION

It is an aim of the present invention to provide an improved cable for use downhole.

In accordance with one aspect of the present invention, there is provided a cable for connection to sensors permanently downhole, the cable comprising a plurality of elongate conductors capable of operative connection to sensors, a sheath surrounding the elongate conductors and holding the conductors so as to extend substantially parallel to an elongate axis, wherein the sheath has a cross-section, perpendicular to the direction of the elongate axis, which has a major dimension and a minor dimension. The cable thus has a substantially elongate, or flattened, cross-sectional shape.

Such a cable is particularly advantageous in permanent monitoring of wells producing oil where sensing of parameters downhole is required throughout the life of a well.

The cross-section of the sheath may be substantially in the shape of an ellipse, which simplifies manufacture of the cable. However other types of cross-section are also suitable, and thus the sheath may have a cross-section where the major dimension and minor dimension are provided by a shape comprising a circle with wing-like portions attached on opposite sides of the circle. Alternatively the cross-section may be substantially in the shape of a crescent.

The sheath preferably comprises a resilient material, so as to provide a robust outer surface of the cable which prevents the cable breaking when being installed downhole.

The resilient material may be a thermoset material, such as nitrile rubber, to allow for ease of welding of electrodes to the cable.

The conductors are preferably each made from a solid conductive material, such as copper, so as to provide maximum conductivity in minimum cross-sectional area. As the cable is intended primarily for use downhole, the conductors may desirably be plated with a protective material, such as nickel, to provide protection against corrosive liquids and gases. Additionally, the conductors may also include optical fibres.

Preferably each conductor is insulated with a polymer material, such as ethylene propylene copolymer, so as to electrically isolate the conductor from other conductors carried within the sheath.

Further reduction in electrical interaction between the conductors may be achieved by a number of elongate conductors being grouped together. Each group has the conductors inter-weaved in a helical arrangement so as to reduce electrical cross-talk amongst the different conductors within the group.

Typically the cable will include four groups of conductors, each group consisting of four conductors. However the number of groups used, and the number of conductors in those groups, will depend on the number of conductors used in the cable. The cable may also comprise a plurality of strengthening elements, spaced from the conductors, so as to improve robustness and rigidity of the cable. Typically each strengthening element is a wire cord or rope of greater diameter than each group of conductors, and generally a first wire rope is placed near one end of the major dimension, and a second wire rope placed near the opposite end of the major dimension. The wire ropes provide crush resistance should the cable be subjected to force perpendicular to its elongate axis, and also stiffen the cable and provide axial strength. Cable stiffness is of particular advantage when feeding the cable downhole and cementing the cable in place.

The wire cord may comprise a number of separate strands and may be hollow to allow passage of a fibre optic cable within the wire cord. This is of particular use where optical signals are to be transmitted along the length of the borehole as the hollow wire cord provides both a conduit for the fibre optic cable and also a protective shield for the fibre optic cable.

The invention also lies in a method of cementing a well, comprising forming a borehole, placing elongate tubing within the borehole to form an annulus in the borehole, and placing within the annulus a cable with a cross-section which has a major and a minor dimension, such that the minor dimension extends along a radius of the borehole, and passing cement, or thixotropic fluid, downhole to secure the cable in the annulus.

The cable may have the preferred features as set out above.

The cable preferably adjoins the elongate tubing, such that the major dimension of the cross-section extends generally in an arc within the annulus.

As the minor dimension of the cross-section runs partially along a radius of the borehole, the distance from an outside wall of the borehole to the cable is maximised. This reduces the likelihood of mud not being displaced from the region between the cable and the outer wall of the borehole when cementing occurs.

The method may further comprise securing the cable to the elongate tubing, or sections of tubing before the tubing is placed downhole. The cable may be secured by clamps designed to withstand pressure downhole.

In accordance with a further aspect of the present invention, there is provided a well comprising a borehole, elongate tubing placed within the borehole so as to form an annulus extending along the length of the borehole, and a cable placed within the annulus, the cable having a cross-section, perpendicular to the length of the borehole, which has a major and a minor dimension.

The cable may have the preferred features as set out above.

The cable preferably adjoins the elongate tubing, such that the minor dimension of the cross-section runs along part of the borehole radius.

Desirably the cable is secured within the annulus by introducing cement, or thixotropic fluid, into the annulus.

The substantially elongate cross-section of the cable ensures that by appropriate placing of the cable, the distance between the cable and the outer wall of the borehole is maximised. This improves the likelihood of successful cementing of cable into the borehole.

BRIEF DESCRIPTION OF THE DRAWINGS

The invention will now be described by way of example, and with reference to the accompanying drawings in which.

DETAILED DESCRIPTION OF THE INVENTION

Figure 1:
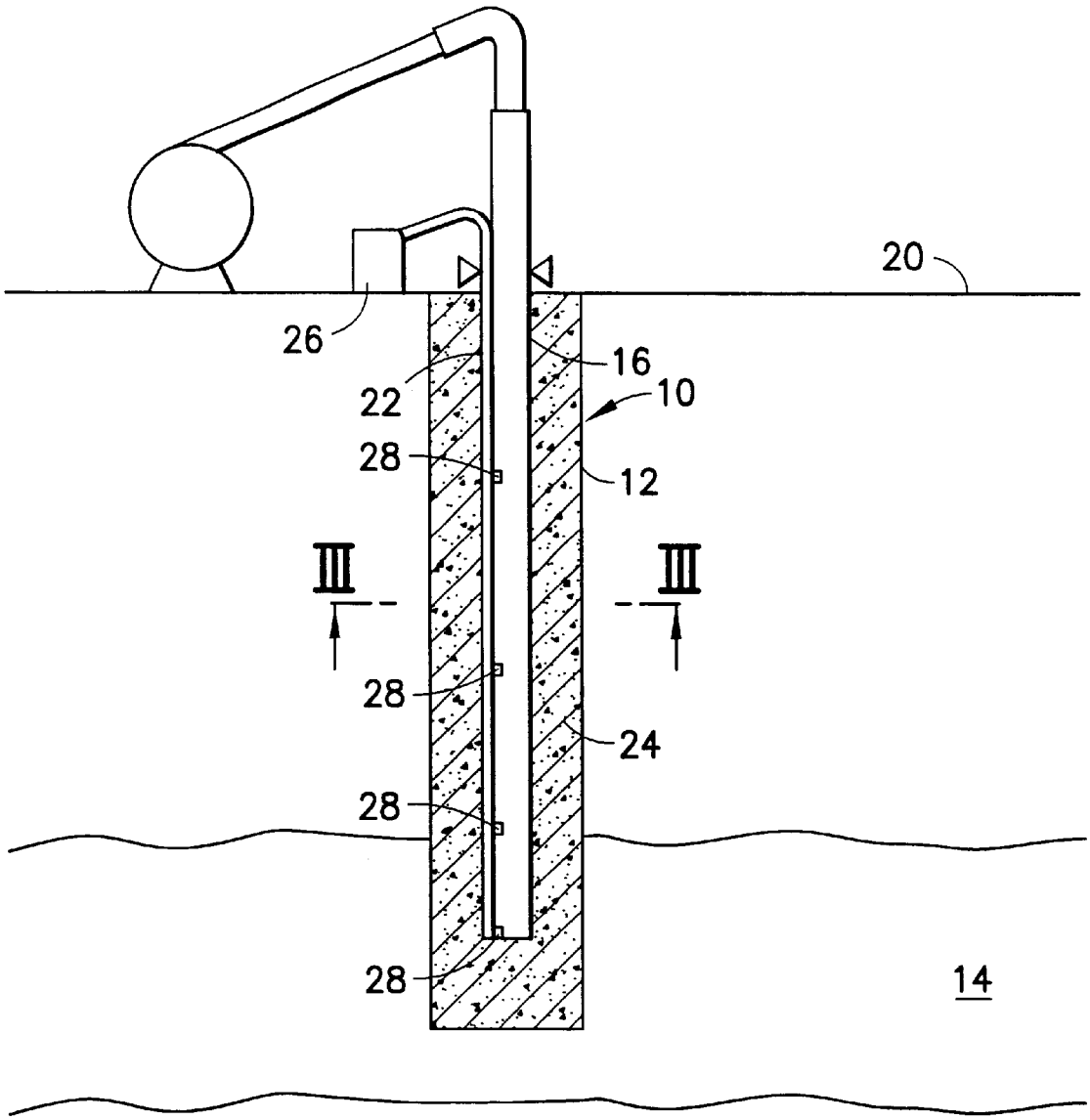
FIG. 1 shows a schematic diagram of a well with a cable placed within a well borehole in accordance with the various aspects of the present invention.

A schematic diagram of a well 10 is shown in FIG. 1, where a borehole 12 has been drilled down to a stratum 14 from which oil or another substance is to be produced. Casing 16, through which oil flows to reach surface 20, is shown positioned within the circular cross-section borehole 12. In many cases, the oil flows through one or more production tubings that are provided within casing 16. Running alongside the production tubing, or casing, is a cable 22 which is permanently positioned within the borehole by cement 24 that has been injected into the casing to displace mud left within the borehole 12 after the drilling process. The cable 22 is connected to surface electronics 26 on surface 20, and a number of sensors 28 are in contact with the cable 22 along its length to permanently monitor the well over its lifetime. Note, that according to the present invention, cable 22 could be positioned between a production tubing and a casing 16.

Figure 2:
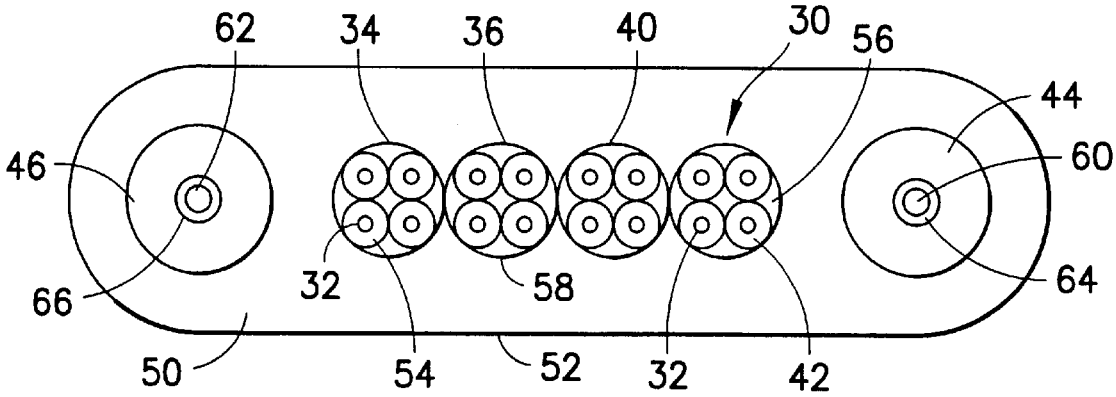
FIG. 2 shows a cross-section through a preferred embodiment of a cable in accordance with the present invention.

A cross-section of one preferred embodiment of the cable 22 is shown in FIG. 2, and from this it will be seen that the cable cross-section 30 is of substantially elliptical shape. The flat-pack design cable comprises sixteen conductors 32 arranged in four groups 34, 36, 40, 42 of four conductors and two wire ropes 44, 46 at respective ends of the major dimension of the cross-section. A filler material 50 surrounds and secures the conductors 32 in fixed relation to the wire ropes 44, 46 and also provides an external jacket 52 of the cable.

The cross-section of the cable is flattened and elongate when compared to a conventional circular cable, reducing the likelihood of the cable snagging on the casing when the cable is placed downhole. Typically the cable 22 is placed downhole by securing the cable to the outer wall of the casing or production tubing using protectors and centralisers, and then fed downhole as successive portions of casing or production tubing are inserted in the borehole.

The electrical core of the cable 22 which provides power to sensors downhole, consists of the four identically sized groups 34, 36, 40, 42 of metallic conductors 32. The conductors 32 are made from solid strands of copper, each strand being externally plated with a layer 54 of nickel so as to resist corrosion from any liquid or gas contacting the conductors when the cable 22 is downhole. Each conductor is electrically isolated from the three other conductors in their respective group by an outermost coating 56 of ethylene propylene copolymer insulation. Other insulators may be chosen depending on a particular well's downhole characteristics.

To further reduce electrical communication between respective conductors within a group and to improve cable handling, the conductors within each group are twisted together in a helix so as to reduce electrical cross-talk between circuits within the cable 22. When the conductors 32 are twisted together into this helical arrangement, a polysulphide rubber compound filler 56 is used to fill the voids in the helix and resulting groups are encased within Mylar tape binder 58, and also Neo Nylon binder. In this way, all interstitial spaces in the helix are filled and a composite group of conductors is produced ready for assembly into the cable 22. Cable 22 could also comprise coaxial cables for increased bandwidth.

As shown in FIG. 2, the bundles 34, 36, 40, 42 of conductors are placed adjacent one another with the two wire ropes 44, 46 spaced from the four adjoining bundles. A nitrile rubber jacket 52 surrounds and envelops the two wire ropes 44, 46 and the four bundles of conductors to secure them in a fixed relationship. The wire ropes and bundles are positioned along the longest axis, or major dimension, of the cross-section, so maximising the number of conductors that can be provided within the narrow cross-section cable 22.

The nitrile rubber jacket and filler used in the groups ensure that the cable is free of voids, so minimising any fluid passage that might occur within the cable in the axial direction.

Integral electrodes for sensing purpose can be moulded onto the cable to limit interface problems between the cable and electrodes. The solid copper conductors ensure that welding of electrode wires running along the outside of the cable to the conductors is relatively straightforward, such welding also being assisted by the thermosetting qualities of the nitrile rubber jacket which ensures it is less time consuming to weld electrodes to the cable conductors. Where electrodes are welded onto the conductors, the conductors are replated with nickel over the weld area to ensure that a continuous layer of corrosion protective coating is maintained.

The wire ropes 44, 46 have a greater diameter than each composite bundle of conductors and so provide protection for the bundles should the cable 22 be crushed transversely to its direction of elongation, such as when installing the cable. The wire ropes 44, 46 also provide axial strength and stiffen the cable 22, so improving rigidity and robustness of the cable when positioning downhole. The stiffness is also of advantage when the cable 22 is cemented into position within the borehole 12.

The wire ropes 44, 46 can be armoured single or multi-conductor logging cables, or logging cable that includes one or more optical fibres. Single-mode optical fibres 60, 62 are shown included in the cable in FIG. 2, and are placed centrally within each wire rope and encased in a stainless steel tube 64, 66 is filled with gel which runs along the centre of the wire rope. The optical fibres 60, 62 are thus protected from breakage both by the cushioning effect of the gel and the rigid case provided by the wire ropes 44, 46.

The cable jacket material, whilst typically nitrile rubber, may be made of any other material which resists the conditions downhole, although is desirably of a thermoset material that allows for easy over-moulding of electrodes which may be attached to the cable where resistivity measurements are required downhole.

Figure 3:
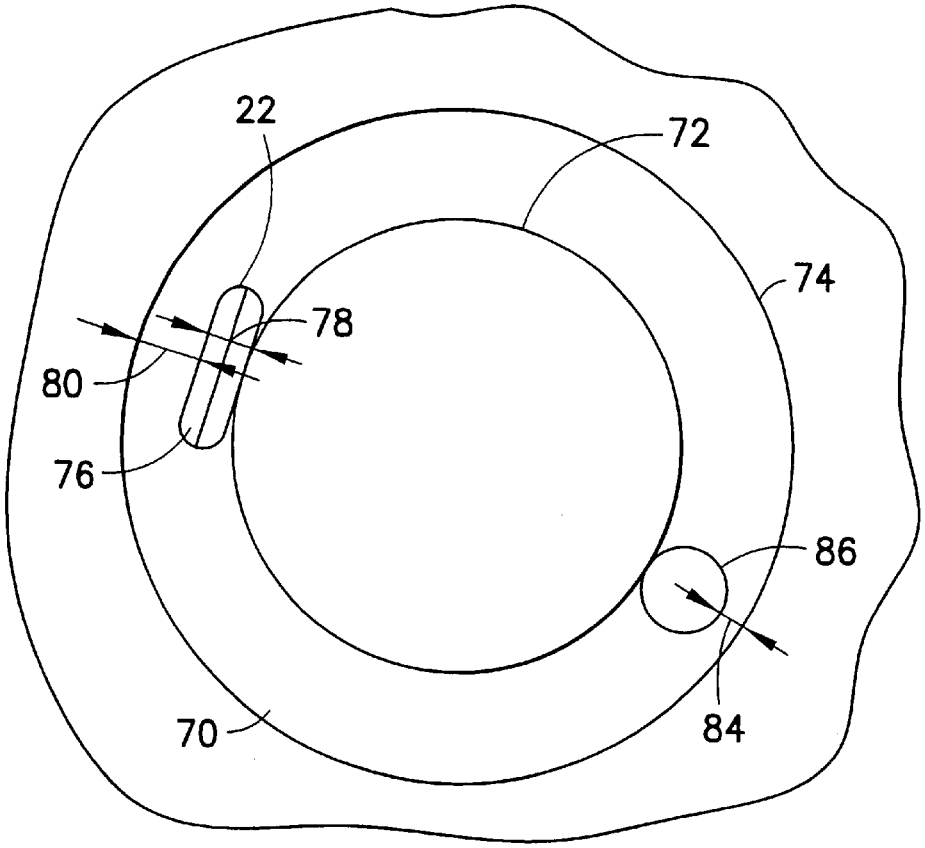
FIG. 3 shows a sectional view along line III—III of FIG. 1.

In FIG. 3, a sectional view through the well along line III—III of FIG. 1 is shown. This illustrates the position of the cable 22 shown in FIG. 2, and compares this with a circular cross-section cable. Typically the borehole has a diameter of 8½ inches, and the production tubing or casing 16, placed centrally within the circular cross-section borehole 12 has a diameter of 5½ inches, so forming an annulus of 1½ inches in width. The respective diameters of the casing and borehole may vary, for example a borehole of 12¼ inches with a casing of 9⅝ inches may be used or a borehole of 8½ inches, with a casing of 4½ inches diameter.

The cable 22 is placed in annulus 70 formed between an outer wall 72 of the casing and the wall 74 of the borehole 12. The cable 22 adjoins the casing 16 such that a major dimension 76 of the cross-section of cable 22 runs at right angles to the borehole radius, and thus extends generally along an arc within annulus 70. A minor dimension 78 of the cross-section extends along part of the borehole radius, with a gap 80 of length L left between the cable 22 and the wall 74 of the borehole. The gap 80 is much larger than a gap 84 that would be achieved if a circular cross-section cable 86 were placed in the annulus 70.

Thus use of a flat-pack design cable, which has a flattened cross-section, increases the spacing between the wall of the borehole and the cable over the spacing that is possible with a circular cross-section cable. The limited space between casing and the wall of the borehole can thus be used more effectively, particularly when cementing the cable permanently in position downhole, for the reasons as discussed below.

Figure 4:
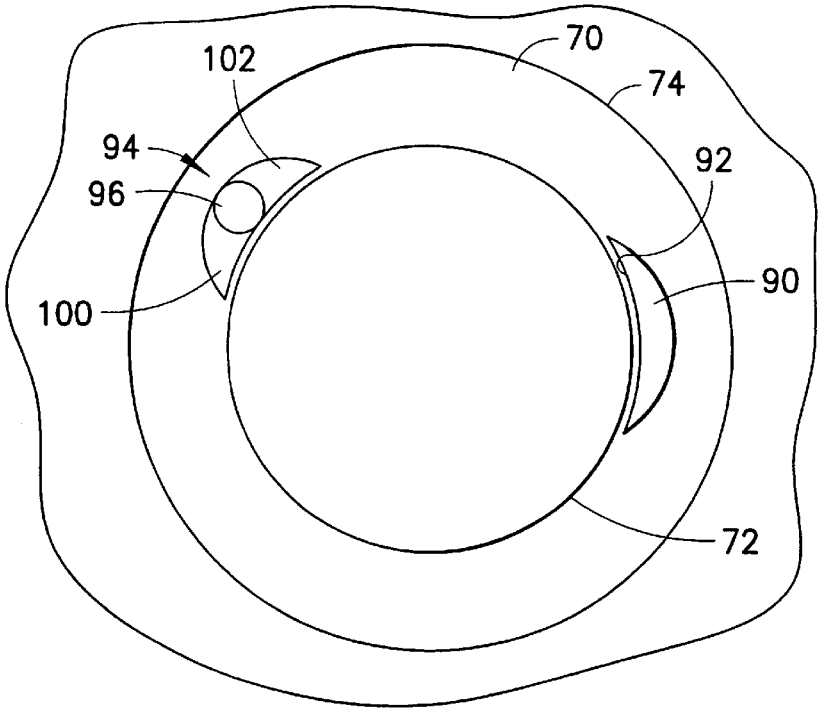
FIG. 4 shows an equivalent sectional view to that depicted in FIG. 3 for two further embodiments of a cable according to the present invention.

Other flattened cross-sections are equally suitable to achieve the increase in spacing between the cable and the wall of the borehole, and two further cable cross-sections are illustrated in FIG. 4.

Cable 90 has a crescent-shaped cross-section, with an inner concave surface 92 of the crescent adjoining the casing wall 72. This generally eliminates any gaps that may occur between the cable and the casing wall 72, and avoids complications during cementing of the cable in the annulus 70.

A further preferred embodiment of a cable in accordance with the present invention is shown in FIG. 4, this third embodiment 94 being comprised of a central circular cross-section cable 96 modified in cross-section by the addition of wings 100, 102 which are moulded onto the cable 96 so as to create an integral flattened cross-section. As with crescent-like cable 90, one surface of the cross-section is substantially concave and this surface is placed so as to adjoin the casing wall 72.

The flattened cross-section of the cable has certain advantages in connection with placing the cable permanently downhole in the annulus between the casing and the wall of the borehole. The flattened cross-section is less likely to catch on the wall or casing and be damaged, and in particular provides certain advantages when cementing the cable in place downhole.

Conventional cementing technology involves isolating the inside of an oil well from a surrounding rock formation by running casing inside the borehole. The outer diameter of the casing is usually one or two inches smaller than the borehole diameter, and cementing is required to displace the annulus of drilling mud, which sits between the casing and the outer wall of the borehole, with cement so that materials from the production stratum can only leave the borehole through the casing in a controlled manner. However successful cementing can be prevented where the distance between the casing and the outer wall of the borehole varies, whether due to the casing not being placed centrally in the borehole or due to other bodies narrowing the distance.

The cementing process will now be briefly described with reference to FIGS. 5 to 8.

Figure 5:
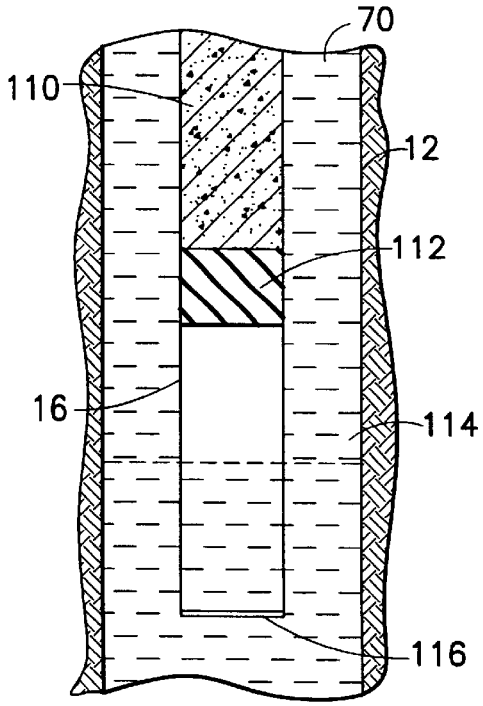
FIGS. 5 and 6 show schematic diagrams illustrating how a borehole is cemented.
Figure 6:
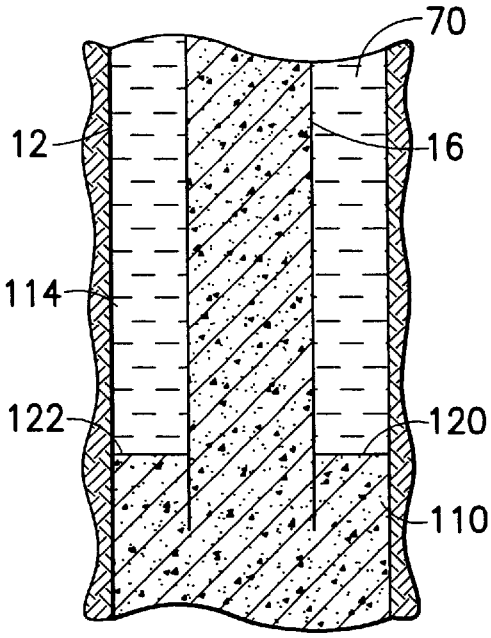

In cementing as shown in FIG. 5, cement 110 is pumped down the inside casing 16, where a rubber plug 112 separates the cement 110 from drilling mud 114. The rubber plug 12 is forced downhole by the pressure of the cement 110, and when the rubber plug 112 reaches a bottom, or shoe 116, of the casing 16, it bursts under pressure so that the cement and mud are then in contact for the first time, see FIG. 6.

Figure 7:
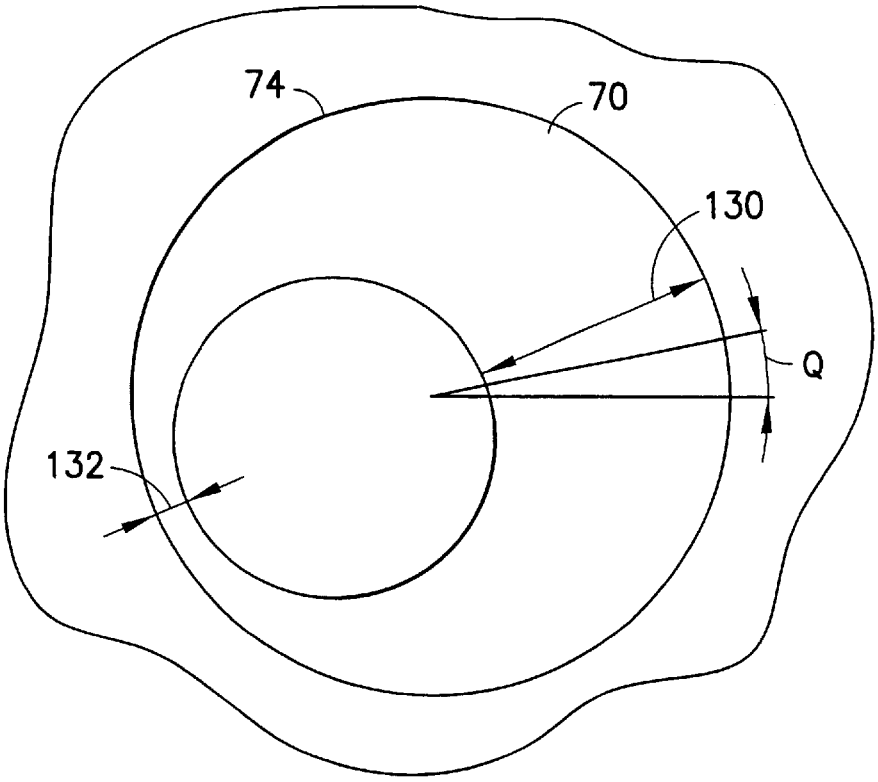
FIG. 7 shows a sectional view along line VII—VII of FIG. 8 where an annulus between casing and a wall of a borehole is of variable width.
Figure 8:
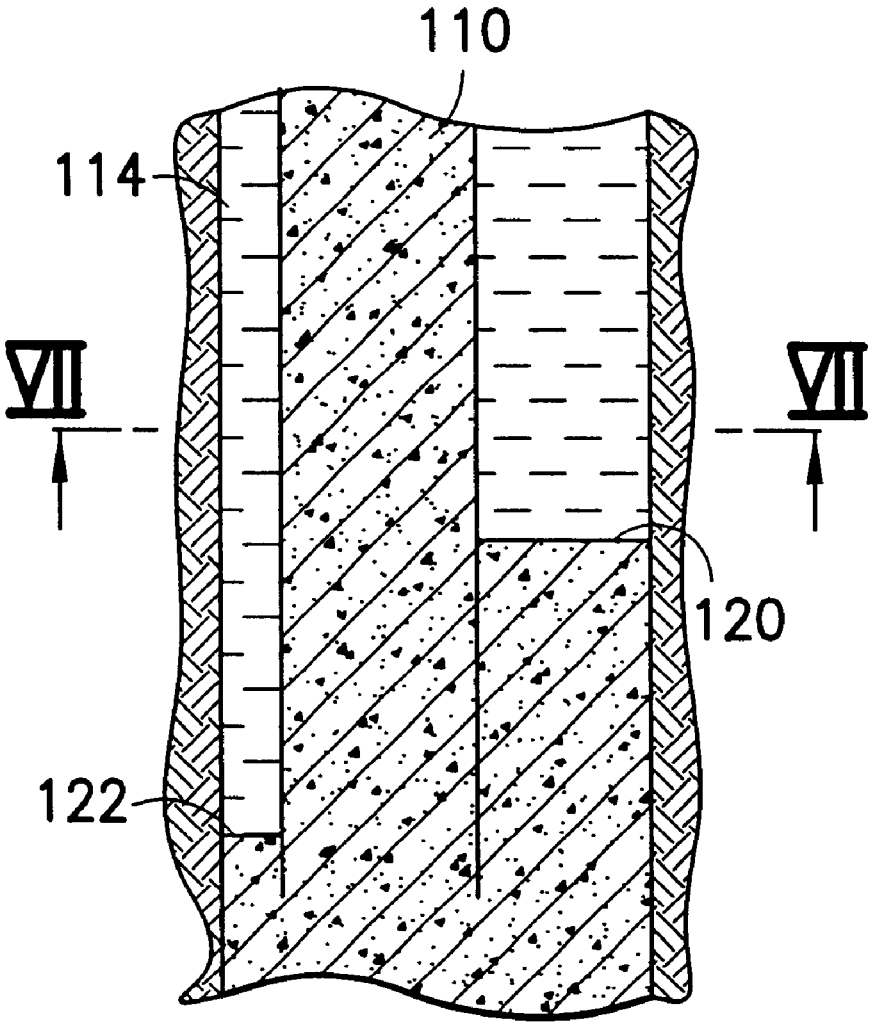
FIG. 8 shows a schematic diagram illustrating cementing for an annulus of variable width.

If the casing 16 is centralised in the hole 12, then the cement 110 pushes the mud 114 out of the annulus 70 so that a mud/cement interface 120, 122 is independent of angle θ (see FIG. 7). This constant width annulus is the optimal geometry for mud displacement.

However in reality the casing 16 is often distorted from a true circular cross-section, see FIG. 7, resulting in an annulus of varying width, such as with a wide gap 130 at θ=0 and a narrow gap 132 at θ=180°. In this situation, the fluid will flow fast on the wide side of the annulus 70 and be static or slow flowing on the narrow side, see FIG. 8. Because the mud 114 has a yield stress, the stress applied to the mud 114 from the narrow side can be so small that the mud does not yield and remains as an immobile solid. The cement will then only push the mud 114 from the wide side of the annulus, and the mud/cement interface will vary over the annulus. The isolation of the inside of the well has then failed and remedial work needs to be performed to ensure full isolation.

Similar problems arise if a circular cable is attached to the outside of the production casing, as this produces a wide and narrow side to the annulus. Increasing the distance from the cable to the wall of the borehole by reducing the width of the cable (as with the first embodiment) improves the likelihood of a successful cementing process as the different in flow about the annulus is not as great. Similarly flattened or crescent-shaped cables reduce the risk of leaving mud on the narrow side of the annulus, when compared to a circular cable with the same cross-sectional area.

We claim:

1. A cable placed in a hydrocarbon borehole between a conduit and a borehole wall, the cable used for connection to sensors permanently or semi-permanently downhole, the cable comprising:

at least sixteen elongate conductors capable of operative connection to sensors; and a sheath surrounding the elongate conductors and holding the conductors so as to extend substantially parallel to an elongate axis, wherein the sheath has a cross-section, perpendicular to the direction of the elongate axis, which has a major dimension and a minor dimension such that when the cable is placed in the borehole between the conduit and borehole wall the likelihood of successful cementing between the conduit and borehole wall is improved over the same if the cable were not so dimensioned.

2. A cable according to claim 1, wherein the cross-section of the sheath is substantially in the shape of an ellipse.

3. A cable according to claim 1, wherein the cross-section of the sheath is substantially in the shape of a crescent.

4. A cable according to claim 1, wherein the sheath comprises a resilient material, so as to provide a robust outer surface of the cable.

5. A cable according to claim 4, wherein the resilient material is a thermoset material to allow for ease of welding of electrodes to the cable.

6. A cable according to claim 1, wherein the conductors are each made from a solid conductive material.

7. A cable according to claim 6, wherein the conductors are plated with a protective material to provide protection against corrosive liquids and gases.

8. A cable according to claim 6, wherein each conductor is insulated with a polymer material so as to electrically isolate the conductor from other conductors carried within the sheath.

9. A cable according to claim 1, wherein further comprises one or more strengthening elements, spaced from the conductors.

10. A cable according to claim 9, where each strengthening element comprises a hollow wire cord.

11. A cable for connection to sensors permanently or semi-permanently downhole, the cable comprising:

one or more elongate conductors capable of operative connection to sensors; and a sheath surrounding the elongate conductors and holding the conductors so as to extend substantially parallel to an elongate axis, wherein the sheath has a cross-section, perpendicular to the direction of the elongate axis, which has a major dimension and a minor dimension, wherein the shape of the cross-section comprises a circle with wing-like portions attached on opposite sides of the circle.

12. A cable for connection to sensors permanently or semi-permanently downhole, the cable comprising:

one or more elongate conductors capable of operative connection to sensors; and a sheath surrounding the elongate conductors and holding the conductors so as to extended substantially parallel to an elongate axis, wherein the sheath has a cross-section, perpendicular to the direction of the elongate axis, which has a major dimension and a minor dimension, wherein a number of elongate conductors are grouped together and inter-weaved in a helical arrangement.

13. A cable for connection to sensors permanently or semi-permanently downhole, the cable comprising:

one or more elongate conductors capable of operative connection to sensors;

a sheath surrounding the elongate conductors and holding the conductors so as to extend substantially parallel to an elongate axis, wherein the sheath has a cross-section, perpendicular to the direction of the elongate axis, which has a major dimension and a minor dimension; and at least one strengthening element, spaced from the conductors, where the at least one strengthening element is dimensioned so as to allow passage of a fibre optic cable within it.

14. A cable according to claim 13, wherein the strengthening element comprising a tube that encases the fibre optic cable.

15. A method of cementing a borehole having a wall comprising the steps of:

placing a conduit within the borehole to form an annulus between the conduit and the borehole wall;

placing within the annulus a cable with a cross-section which has a major and a minor dimension, such that the minor dimension extends along a radius of the borehole, the cable including at least sixteen elongate conductors; and passing cement, or thixotropic fluid, into the annulus such that the cable is secured in the annulus and the well is successfully isolated.

16. A method according to claim 15, wherein the cable is placed so as to adjoin the conduit.

17. A method according to claim 15, further comprising securing the cable to the conduit before the tubing is placed downhole.

18. A method according to claim 15 wherein the cable comprises one or more elongate conductors and one or more electrodes adapted for downhole resistivity measurements, each electrode operatively connected to one or more of the elongate conductors.

19. A well comprising:

a borehole being defined by a borehole wall;

a conduit placed within the borehole so as to form an annulus extending along the length of the borehole between the conduit and the borehole wall, a cable placed within the annulus, the cable having a cross-section, perpendicular to the length of the borehole, which has a major and a minor dimension, the cable including at least sixteen elongate conductors; and cement or thixotropic fluid placed within the annulus successfully isolating the well.

20. A wall according to claim 19, wherein the cable adjoins the conduit, such that the minor dimension of the cross-section runs along part of the borehole radius.

21. A well according to claim 20, wherein the cable is secured within the annulus by the cement, or thixotropic fluid, placed in the annulus.

22. A well according to claim 19, wherein the cable comprises one or more elongate conductors and one or more electrodes adapted for downhole resistivity measurements, each electrode operatively connected to one or more of the elongate conductor.

23. A cable placed in a hydrocarbon borehole between a conduit and a borehole wall, the cable used for connection to sensors permanently or semi-permanently downhole, the cable comprising:

one or more elongate conductors;

one or more electrodes adapted for downhole resistivity measurements, each electrode operatively connected to one or more of the elongate conductors; and a sheath surrounding the elongate conductors and holding the conductors so as to extend substantially parallel to an elongate axis, wherein the sheath has a cross-section, perpendicular to the direction of the elongate axis, which has a major dimension and a minor dimension such that when the cable is placed in the borehole between the conduit and borehole wall the likelihood of successful cementing between the conduit and borehole wall is improved over the same if the cable were not so dimensioned.

24. A cable according to claim 23 wherein the one or more conductors are insulated so as to be electrically isolated.

25. A cable according to claim 23, wherein the sheath comprises a resilient material, so as to provide a robust outer surface of the cable.

26. A cable according to claim 25, wherein the resilient material is a thermoset material to allow for ease of welding of electrodes to the cable.

27. A cable according to claim 23, wherein the conductors are each made from a solid conductive material.

28. A cable according to claim 27, wherein the conductors are plated with a protective material to provide protection against corrosive liquids and gases.

29. A cable placed in a hydrocarbon borehole between a conduit and a borehole wall, the cable used for connection to sensors permanently or semi-permanently downhole, the cable comprising:

at least one optical fiber;

at least one tube that is dimensioned so as to allow passage of the at least one optical fiber within it; and a sheath surrounding the at least one tube so as to extend substantially parallel to an axis of the tube, wherein the sheath has a cross-section, perpendicular to the direction of the axis of the tube, which has a major dimension and a minor dimension such that when the cable is placed in the borehole between the conduit and borehole wall the likelihood of successful cementing between the conduit and borehole wall is improved over the same if the cable were not so dimensioned.

* * * * *